US007828238B2

(12) United States Patent
Gunji

(10) Patent No.: US 7,828,238 B2
(45) Date of Patent: Nov. 9, 2010

(54) MEDIA-AGITATION TYPE WET DISPERSER AND METHOD FOR DISPERSING FINE PARTICLES

(75) Inventor: Susumu Gunji, Tochigi (JP)

(73) Assignee: Nippon Coke & Engineering Co., Ltd., Tokyo (JP)

( * ) Notice: Subject to any disclaimer, the term of this patent is extended or adjusted under 35 U.S.C. 154(b) by 399 days.

(21) Appl. No.: 11/984,457

(22) Filed: Nov. 19, 2007

(65) Prior Publication Data

US 2009/0127358 A1 May 21, 2009

(51) Int. Cl.
*B02C 23/02* (2006.01)

(52) U.S. Cl. ..... 241/171; 241/21; 241/172

(58) Field of Classification Search ..... 241/16, 241/172
See application file for complete search history.

(56) References Cited

U.S. PATENT DOCUMENTS

| | | | | |
|---|---|---|---|---|
| 3,682,399 | A * | 8/1972 | Kaspar et al. | 241/50 |
| 4,222,528 | A * | 9/1980 | Smith | 241/46.02 |
| 4,513,917 | A * | 4/1985 | Szkaradek | 241/46.11 |
| 5,577,675 | A * | 11/1996 | Ishikawa | 241/65 |
| 2004/0021021 | A1 * | 2/2004 | Ishikawa | 241/172 |
| 2004/0113002 | A1 * | 6/2004 | Tessier et al. | 241/275 |

* cited by examiner

*Primary Examiner*—Dana Ross
*Assistant Examiner*—Matthew G Katcoff
(74) *Attorney, Agent, or Firm*—Bacon & Thomas, PLLC

(57) ABSTRACT

A media-agitation type wet disperser is provided which eliminates the group motion of media, attains high dispersion efficiency, and avoids wear problem. A cylindrical vessel having a feed opening for the treating material and a discharge opening for the treated material is equipped with a cylindrical separator and a rotor rotating while being fixed to a rotary shaft. The rotor is composed of pluralities of small rotors each having a cylindrical agitation part and a disk-shaped holding part. The agitation part has pluralities of throughholes connecting the inside and the outside thereof.

11 Claims, 8 Drawing Sheets

MEDIA-AGITATION TYPE WET DISPERSER AND METHOD FOR DISPERSING FINE PARTICLES

BACKGROUND OF THE INVENTION

1. Field of the Invention

The present invention relates to a media-agitation type wet disperser which performs continuous dispersion treatment.

2. Description of the Related Art

Wet dispersion treatment is a treatment of finely pulverizing solid particles in slurry, thus to obtain dispersion containing further finer particles. The treatment is applied in a wide range of fields such as, for example, printer's ink, paint, polymerization toner, color resist, ceramics fine particles, titanium oxide, metal powder, and pharmaceuticals. These are slurry containing inorganic fine particles, organic fine particles, inorganic-organic composite fine particles, or mixture of them.

The media-agitation type disperser is a kind of device applied to above treatment. This type of disperser agitates a slurry treatment liquid and media together in a vessel, hereby pulverizing the particles through the use of the shearing force of the media and dispersing them. The treatment liquid after dispersion is separated from the media by a separator in the vessel, and is discharged from the vessel. A common separator includes sieve type such as gap type and screen type.

The performance of dispersion treatment is significantly affected by the diameter of applied media. Since smaller diameter of the media brings the diameter of the fine particles in the dispersion smaller, recent applications tend to adopt smaller media diameter. Reduced diameter of media, however, raises a problem of segregation phenomenon to forcefully push the media toward the discharge side. To solve the problem, Patent Document 1 proposes a media-agitation type wet disperser having less than 1 in L/D.

As illustrated in FIG. 9, the media-agitation type wet disperser 101 described in Patent Document 1 has a cylindrical vessel 102, a cylindrical separator 103 which divides the vessel 102 into an inner chamber 121 and an outer chamber 122 in the diametral direction of the vessel 102, with pluralities of slits 131 on the separator 103 connecting both chambers each other, a rotary shaft 104 rotatably positioned passing through one side of the vessel 102, a rotor 105 which rotates while being fixed to the rotary shaft 104, a feed opening 106 for the treating material, located at the other side of the vessel 102 and connecting the inside and the outside of the inner chamber, and a discharge opening 107 for the treated material, located at the outer periphery of the vessel 102 and connecting the inside and the outside of the outer chamber.

When the rotor 105 rotates while feeding the treating material from the feed opening 106 into the vessel 102, the treating material is agitated together with the media in the inner chamber 121, thus subjected to pulverization and dispersion treatments, then the mixture flows outward from the center of the vessel 102 therefrom, the slits 131 on the separator 103 separate the media, and finally the treated material is discharged from the vessel 102 via the discharge opening 107 on the outer chamber 122.

The disperser 101 can prevent the segregation of media by decreasing the L/D ratio and by increasing the surface area of the separator 103. The disperser 101, however, has a problem that the media positioned between the rotor 105 and the separator 103 tend to induce group motion there together, which leads to a problem of decreasing the shearing force among media, required to be generated around the rotor 105, thus causing lower treatment efficiency. Also there occurs a problem that media contacting with the surface of the separator 103 reach high speed which is close to the peripheral speed of the rotor 105, which results in wear of the separator 103.

[Patent Document 1] Japanese Patent Application Laid-Open No. 10-15411

SUMMARY OF THE INVENTION

The present invention provides a media-agitation type wet disperser which has a cylindrical vessel, a cylindrical separator which divides the vessel into an inner chamber and an outer chamber in the diametral direction of the vessel, with pluralities of slits on the separator connecting both chambers each other, a rotary shaft rotatably positioned passing through a side of the vessel, a rotor which rotates while being fixed to the rotary shaft, a feed opening for the treating material, located at other side of the vessel and connecting the inside and outside of the inner chamber, and a discharge opening for the treated material, located at the outer periphery of the vessel and connecting the inside and outside of the outer chamber. The disperser can increase the dispersion efficiency and can prevent wear of separator and other parts by suppressing the group motion of media. The present invention also provides a method for dispersing fine particles, which can increase the dispersion efficiency and can prevent wear of separator and other parts.

To solve the above problems, the media-agitation type wet disperser according to a first aspect of the present invention has a cylindrical vessel, a cylindrical separator which divides the vessel into an inner chamber and an outer chamber in the diametral direction of the vessel, with pluralities of slits on the separator connecting both chambers each other, a rotary shaft rotatably positioned passing through one side of the vessel, a rotor which rotates while being fixed to the rotary shaft, a feed opening for the treating material, located at the other side of the vessel and connecting the inside and outside of the inner chamber, and a discharge opening for the treated material, located at the outer periphery of the vessel and connecting the inside and the outside of the outer chamber, wherein the rotor is composed of pluralities of small rotors each having a cylindrical agitation part and a disk-shaped holding part, and the agitation part has pluralities of through-holes connecting the inside and the outside thereof.

The media-agitation type wet disperser according to a second aspect of the present invention is the media-agitation type wet disperser of the first aspect, wherein the inner chamber is in a cylindrical shape having a diameter D and a length L between both ends, satisfying the formula (1)

$$0.3N<L/D<0.75N \quad (1)$$

where N is the number of the small rotors.

The media-agitation type wet disperser according to a third aspect of the present invention is the media-agitation type wet disperser of the first aspect or the second aspect, wherein both ends of the inner chamber have a curved cross sectional shape with a radius of curvature of R, reducing the diameter of the inner chamber from the original inner diameter toward the end of the vessel, satisfying the formula (2) in relation to the diameter D $$D/30<R<D/3 \quad (2).$$

The media-agitation type wet disperser according to a fourth aspect of the present invention is the media-agitation type wet disperser of any of the first aspect to the third aspect, wherein the outer diameter d of the agitation part and the diameter D satisfy the formula (3)

$$0.70<d/D<0.97 \quad (3).$$

The media-agitation type wet disperser according to a fifth aspect of the present invention is the media-agitation type wet disperser of any of the first aspect to the fourth aspect, wherein the width w of the agitation part, the length L, and the number N satisfy the formula (4)

$$0.7\,L<wN<0.9\,L \quad (4).$$

The media-agitation type wet disperser according to a sixth aspect of the present invention is the media-agitation type wet disperser of any of the first aspect to the fifth aspect, wherein the throughhole inclines in the direction from the inner peripheral face to outer peripheral face of the agitation part so as to recess against the rotational direction.

The media-agitation type wet disperser according to a seventh aspect of the present invention is the media-agitation type wet disperser of any of the first aspect to the sixth aspect, wherein the agitation part has a projection at the outer periphery thereof.

The media-agitation type wet disperser according to an eighth aspect of the present invention is the media-agitation type wet disperser of any of the first aspect to the seventh aspect, wherein the agitation part is divided into two sections by the holding part, and is provided with the throughhole at both sides of the divided two agitation sections.

The media-agitation type wet disperser according to a ninth aspect of the present invention is the media-agitation type wet disperser of any of the first aspect to the eighth aspect, wherein the holding part has an opening.

The method for dispersing fine particles according to a tenth aspect of the present invention is the method for dispersing slurry inorganic fine particles, organic fine particles, inorganic-organic composite fine particles, or mixture of them, adopting the media-agitation type wet disperser of any of the first aspect to the ninth aspect.

The method for dispersing fine particles according to an eleventh aspect of the present invention is the method for dispersing fine particles described in the tenth aspect, wherein, when the media filled in the vessel are assumed to be in a state of closest packing in a ring shape around the agitation part, the thickness A of the ring, the length L, and the number N satisfy the formula (5)

$$0.67N<L/A<1.5N \quad (5).$$

With the above structure, the media-agitation type wet disperser of the present invention creates circulation flow at the agitation part of the small rotor, passing through the throughhole. That is, the treating material and the media around the agitation part of the small rotor at the throughhole flow from the inside to the outside thereof, while outside the agitation part flow from the center to the end of the agitation part, at the end of the agitation part flow from the outside to the inside thereof, and inside the agitation part flow from the end to the throughhole.

Thus created circulation flow prevents the group motion of the media around the agitation part, thereby generating strong shearing force among media to allow highly-efficient pulverizing and dispersing treatments. In addition, the elimination of group motion decreases the flow speed of media in the vicinity of the separator, thereby preventing wear of the separator and other parts.

DESCRIPTION OF THE PREFERRED EMBODIMENTS

Figure 1:
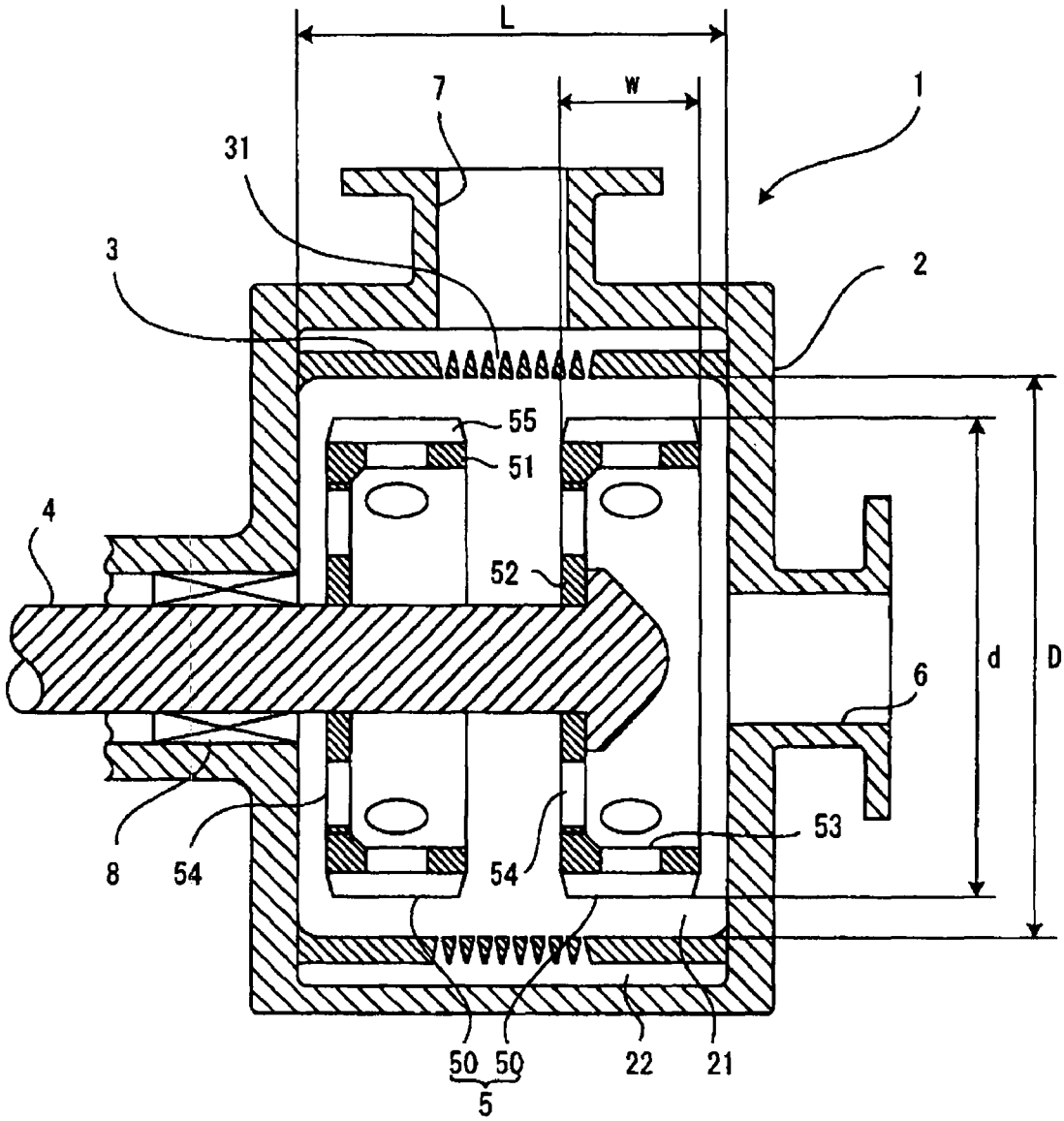
FIG. 1 shows a schematic cross sectional view in an embodiment of the media-agitation type wet disperser of the present invention.

The embodiments of the present invention are described below referring to the drawings.

Figure 2:
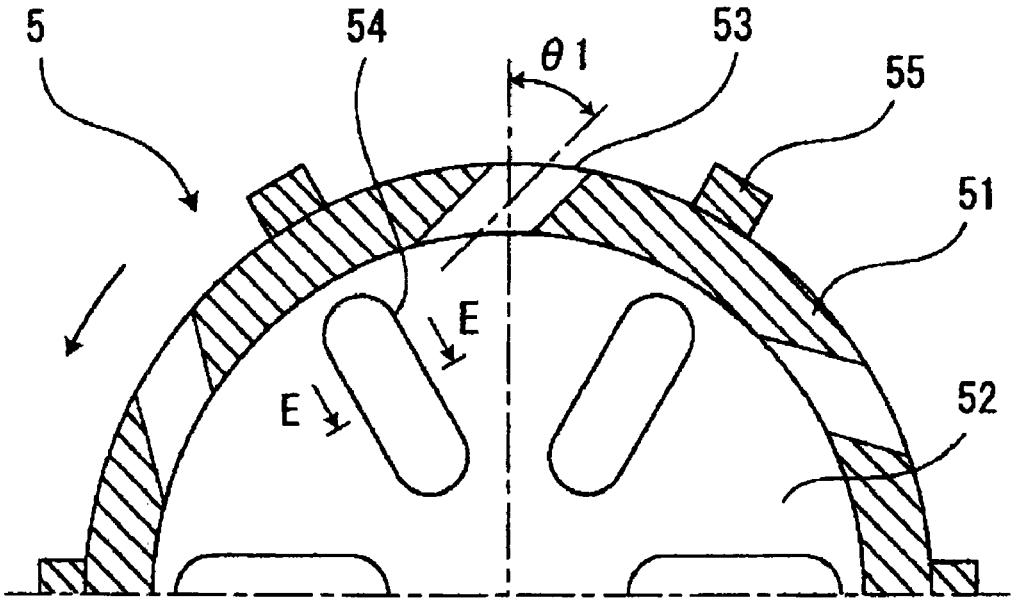
FIG. 2 shows a schematic cross sectional view of the rotor of FIG. 1.
Figure 3:
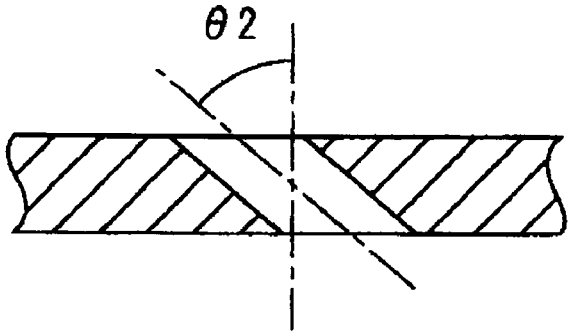
FIG. 3 shows a schematic sketch of E-E section of FIG. 2.

FIGS. 1 to 8 illustrate the embodiments of the media-agitation type wet dispersers according to the present invention. FIG. 1 shows a schematic cross sectional side view of the media-agitation type wet disperser, and FIG. 2 shows a schematic cross sectional view of the rotor.

The media-agitation type wet disperser 1 has a cylindrical separator 3 and a rotor 5 rotating while being fixed to a rotary shaft 4, inside a cylindrical vessel 2 equipped with a feed opening 6 for the treating material and a discharge opening 7 for the treated material. The rotor 5 is composed of pluralities of small rotors 50.

The vessel 2 is divided into an inner chamber 21 and an outer chamber 22 in the diametral direction thereof by the cylindrical separator 3. Since the pulverizing and the dispersion treatments are conducted in the inner chamber 21, the internal shape of the inner chamber 21 is an important structural element of the present invention. That is, when the length between both internal ends of the vessel 2 is expressed by L, and the inner diameter of the separator 3 is expressed by D, they represent the length L between both ends, and the diameter D, in terms of the cylindrical inner chamber 21. When the number of the small rotors 50 is expressed by N, the ratio of the length L to the diameter D, L/D, is preferably selected in the range of $0.3N<L/D<0.75N$. By selecting L/D to smaller than 0.75N, even the media having small diameter can suppress the generation of segregation phenomenon and group motion of media. By selecting L/D greater than 0.3N, the working range of the rotor 5 can be satisfactorily secured.

Figure 4:
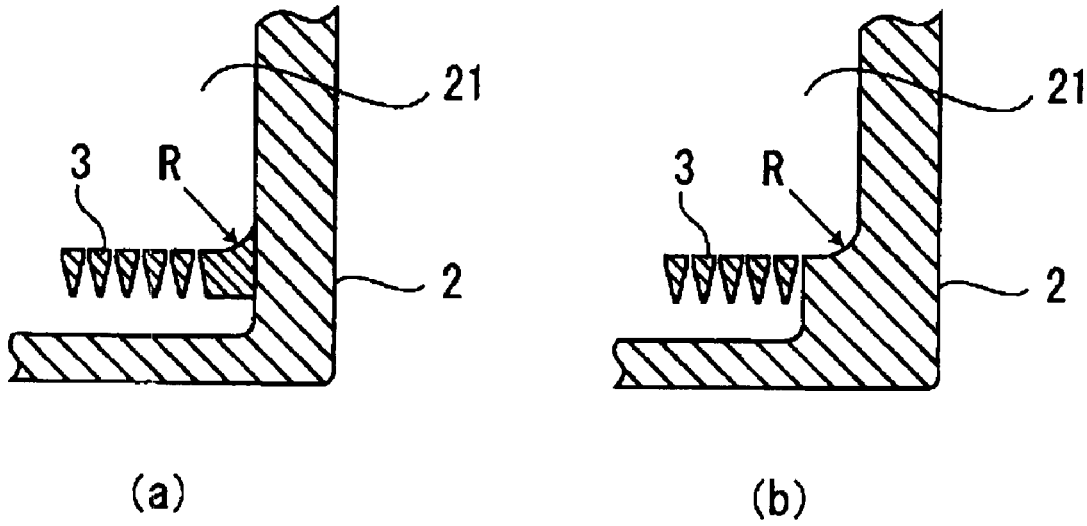
FIG. 4 shows a schematic sketch of cylinder edge corner of the inner chamber.

Both ends of the inner chamber 21 are preferably formed in a curved cross sectional shape with a radius of curvature of R, reducing the diameter of the inner chamber from the original inner diameter toward the end of the vessel, satisfying $D/30<R<D/3$ in relation to the diameter D. By establishing both ends of the inner chamber 21 in a curved cross sectional shape, the flowability of the circulation flow is improved, and the generation of segregation phenomenon and group motion is suppressed. The portion in a curved shape may be the one, as illustrated in FIG. 4(*a*), in which the inner diameter of the separator 3 is formed in a curved shape, or the one, as illustrated in FIG. 4(*b*), in which both ends of the vessel 2 are formed in a curved shape.

The separator 3 is a screen type having pluralities of slits 31, and the slits 31 connect the inner chamber 21 and the outer chamber 22. The treating material is agitated together with the media in the inner chamber 21 to be subject to the pulverizing and the dispersing treatments, and then is separated from the media by the separator 3, thus being able to move to the outer chamber 22. The width of the slit 31 is determined based on the diameter of the media, and the total area of the slits is determined by the properties and flow rate of the treating material.

The rotary shaft 4 penetrating a side of the vessel 2 is rotatably provided and the rotor 5 composed of pluralities of small rotors 50 is fixed to the rotary shaft 4. The rotary shaft 4 is sealed by a seal member 8. By rotating the rotary shaft 4 using a driving source (not shown), the treating material and the media within the inner chamber 21 can be agitated. At the other side of the vessel 2, the feed opening 6 for the treating material is positioned connecting the inside and the outside of the inner chamber 21, while at outer periphery of the vessel 2, the discharge opening 7 for the treated material is positioned connecting the inside and the outside of the outer chamber 22.

The rotor 5 is designed to create circulation flow, and is an important structural element of the present invention. That is, the rotor 5 is composed of pluralities of small rotors 50. Each of the small rotors 50 has a cylindrical agitation part 51 and a disk-shaped holding part 52. The small rotor 50 may be an edge-holding type, having the holding part 52 at the edge of the agitation part 51, or may be a center-holding type, having the small rotor 50 at center of the agitation part 51 to divide the agitation part 51 into two sections. In the case of center-holding type, a throughhole 53 is located at both sides of the divided two sections.

The media-agitation type wet disperser 1 shown in FIG. 1 has two edge-holding type small rotors 50. The media-agitation type wet disperser 1 shown in FIG. 6 has three center-holding type small rotors 50. The media-agitation type wet disperser 1 shown in FIG. 7 has one edge-holding type small rotor 50 and two center-holding type small rotors 50. Other than above, the number and the combination of small rotors can arbitrarily be selected.

The media which are subjected to centrifugal force flow through the throughhole 53 from the inside to the outside thereof. To increase the flowability, the throughhole 53 preferably inclines in the direction from the inner peripheral face to the outer peripheral face of the agitation part 51 so as to recess against the rotational direction. As shown in FIG. 2, it is specifically preferred that the angle $\theta 1$ is in the range of 0° to 60° against the line extending from the center of width of the agitation part 51 to the shaft center.

Through the rotation of the rotor 5, the media around the agitation part 51 are subjected to shearing force and centrifugal force. Owing to a projection 55 at the outer periphery of the agitation part 51, the shearing force and the centrifugal force are strengthened. In addition, by arranging the throughhole 53 and the projection 55 alternately along the periphery, the creation of circulation flow is further enhanced.

The relation between the rotor 5 and the inner chamber 21 is preferably in a range of $0.70<d/D<0.97$, where d is the outer diameter of the agitation part 51 and D is the diameter of the inner chamber 21. The range can give better creation of circulation flow and efficient pulverizing treatment and dispersing treatment. The width w of the agitation part 51, the length L of the inner chamber 21, and the number N of the small rotors 50 preferably have the relation of $0.7\,L<wN<0.9\,L$. The range gives better creation of circulation flow and efficient pulverizing treatment and dispersing treatment.

Figure 5:
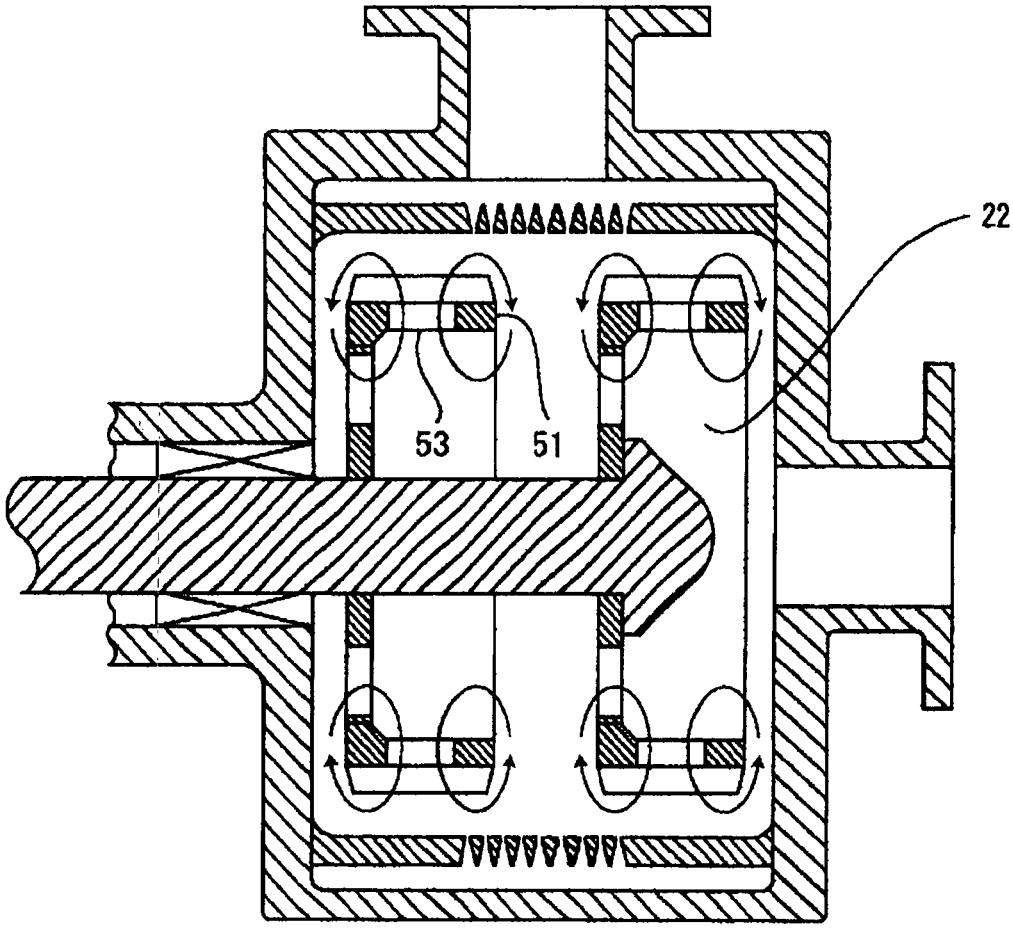
FIG. 5 illustrates the direction of circulation flow.
Figure 6:
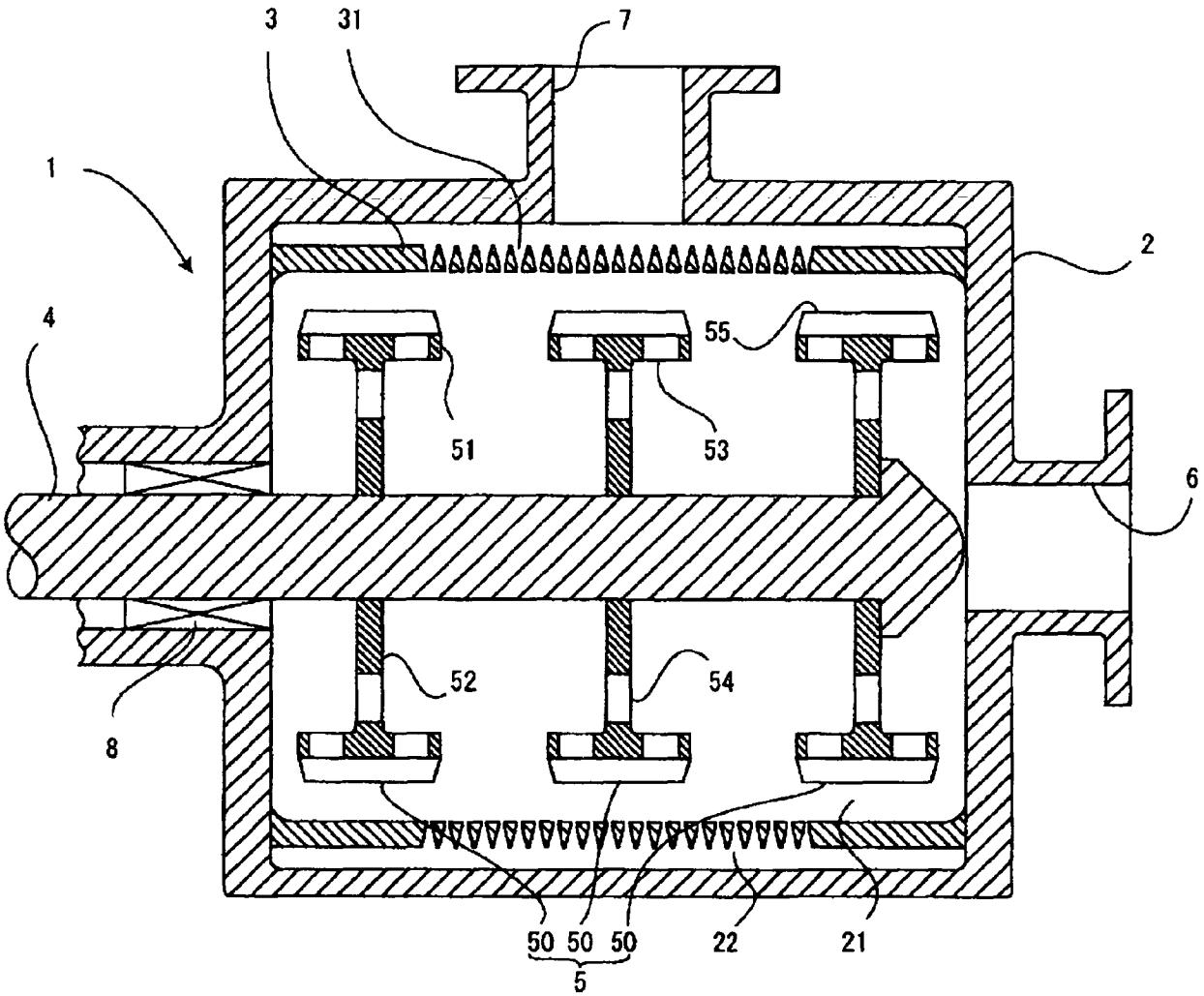
FIG. 6 shows a schematic cross sectional view in another embodiment of the media-agitation type wet disperser of the present invention.
Figure 7:
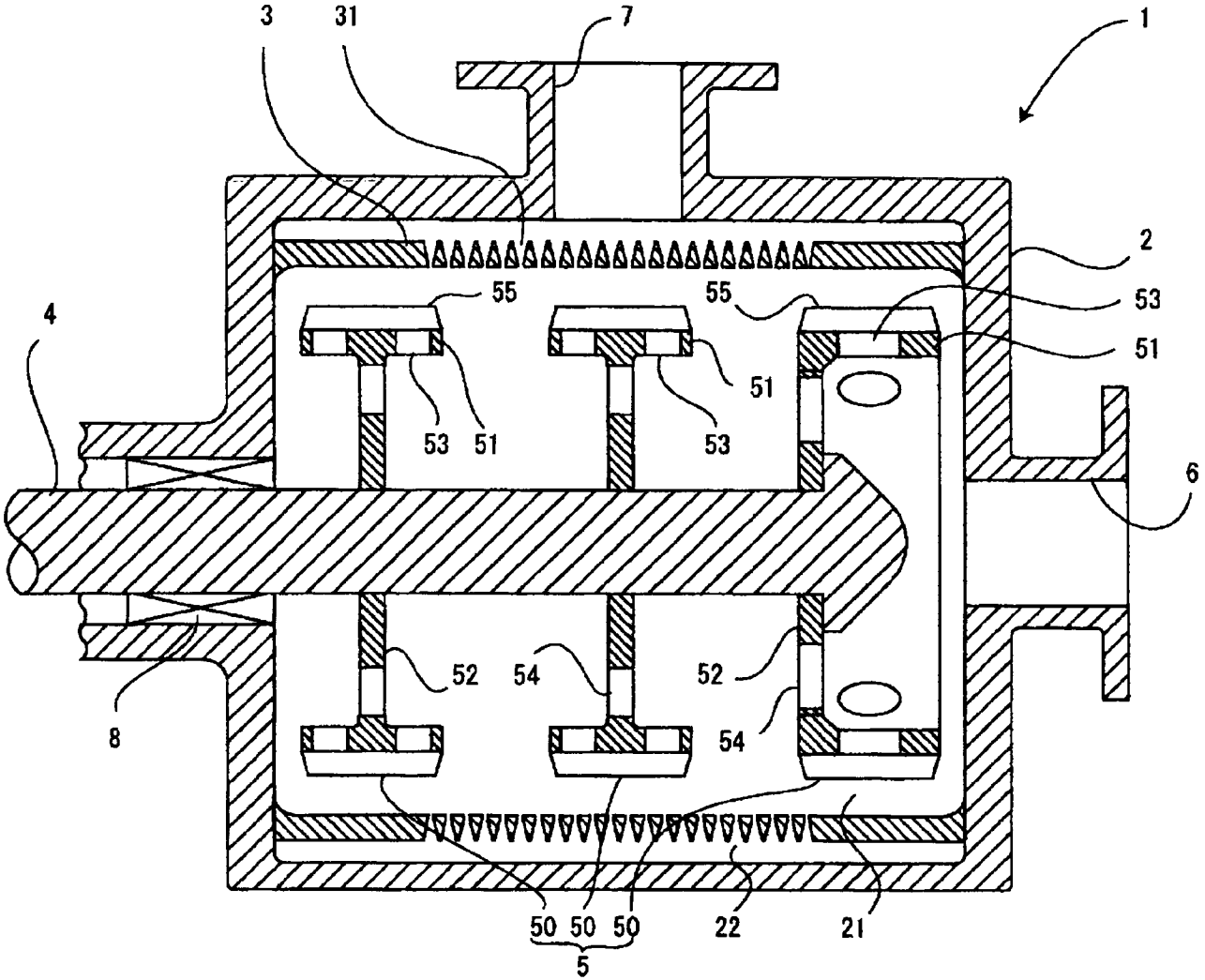
FIG. 7 shows a schematic sketch in further embodiment of the media-agitation type wet disperser of the present invention.
Figure 8:
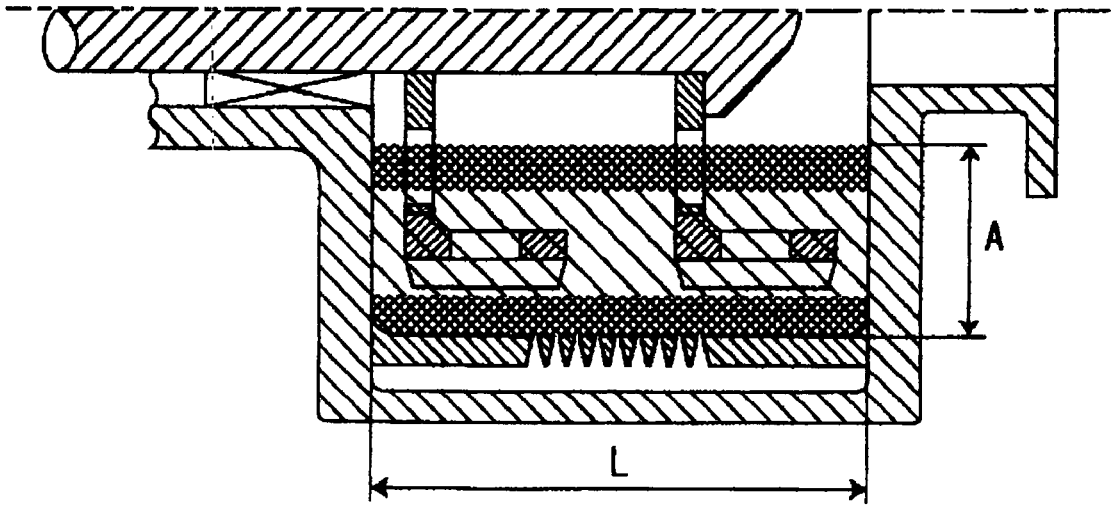
FIG. 8 illustrates the filling state of media.
Figure 9:
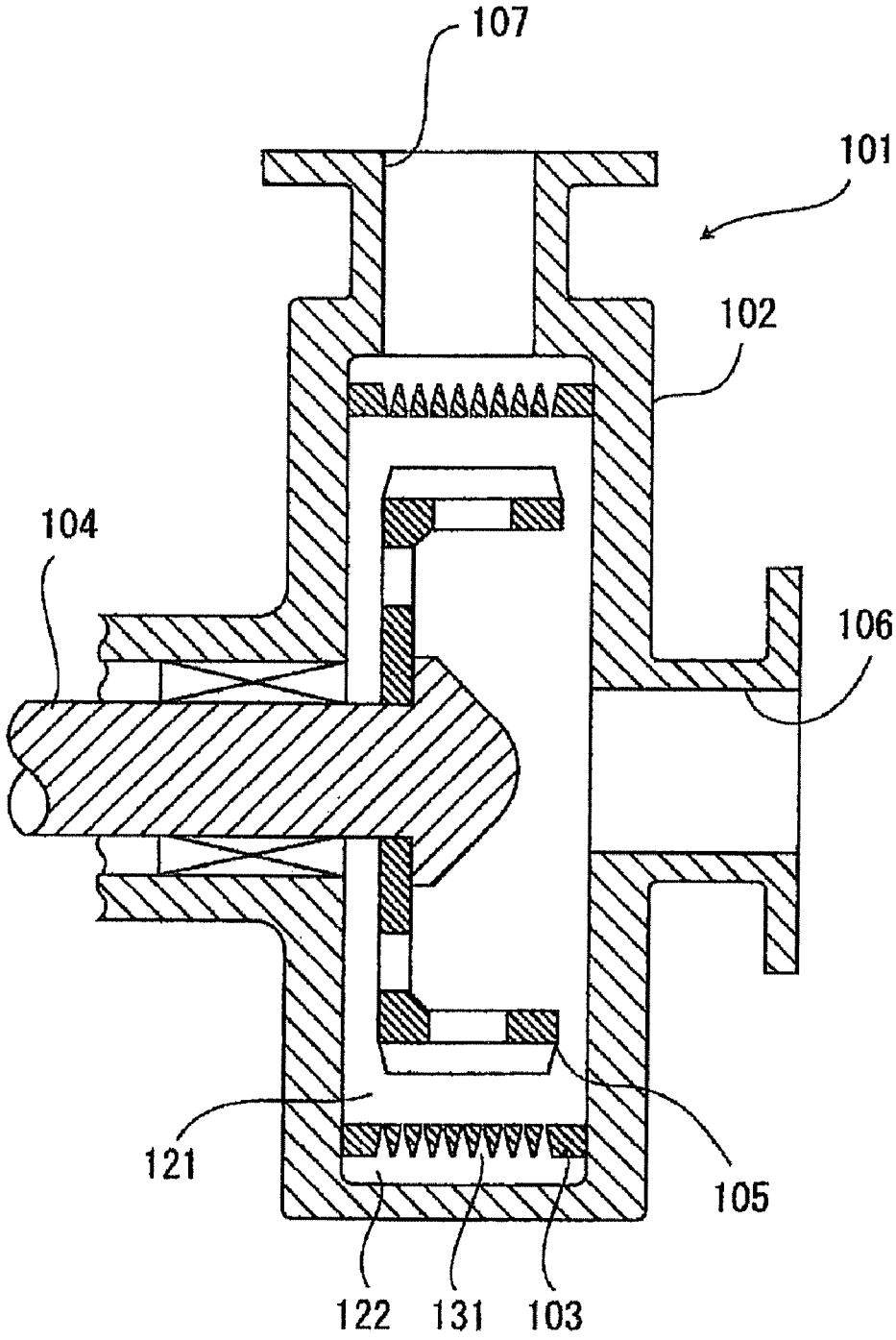
FIG. 9 (PRIOR ART)
FIG. 9 shows a schematic cross sectional view of the conventional media-agitation type wet disperser.

With the above shape, for each small rotor 50, the treating material and the media around the agitation part 51 generate the circulation flow indicated by arrow in FIG. 5. That is, the circulation flow directs from the inside to the outside at the throughhole 53, directs from the center to the end of the agitation part 51 outside the agitation part 51, directs from the outside to the inside at the end of the agitation part 51, and directs from the end to the throughhole 53 inside the agitation part 51.

It is preferable that the inside of the agitation part 51 is kept in a good mixing state, and that the holding part 52 has an opening 54 to avoid the separation in the holding part 52. As viewed in E-E section of FIG. 2, the opening 54 preferably has an angle $\theta 2$ illustrated in FIG. 3. The direction of the angle $\theta 2$ can increase the flow of the treating material and the media from one side to the other of the inner chamber 21 or from the other side to one side thereof. For the pluralities of openings 54, by changing the flow directions alternately, the difference between both sides is eliminated to attain an overall homogeneous mixing state.

With the above structure of the inner chamber 21 and the rotor 5, the inner chamber 21 assures good pulverizing and dispersing treatments inside thereof. That is, between the inner wall of the separator 3 and the outer periphery of the agitation part 51 of the rotor 5, a large velocity difference is given among the media, thereby creating strong shearing force. At the same time, circulation flow is created at the agitation part 51 of each small rotor 50. The direction of the flow caused by the circulation flow is perpendicular to the direction of flow caused by the rotation of the rotor 5. As a result, the media cannot move together with the agitation part 51, thus eliminating the segregation phenomenon and the group motion.

When the media-agitation type wet disperser 1 of the present invention feeds the treating material to the vessel 2 via the feed opening 6, and rotates the rotor 5, the treating material is agitated together with the media filled in the inner chamber 21, and is subjected to the pulverizing and the dispersing treatments. Then, the mixture flows outward from the center of the vessel 2, and the slits 31 of the separator 3 separate the media, then the treated material is discharged from the outer chamber 22 to the outside of the pulverizing vessel 2 via the discharge opening 7.

At the peripheral area of the inner chamber 21, the strong shearing force among media allows highly-efficient pulverizing and dispersing treatments. At the same time, the flow speed of the media decreases in the vicinity of the separator 3 through the elimination of group motion, thus preventing the wear of the separator 3 and other parts. In the vicinity of the center of inner chamber 21, the treating material and the media keep homogeneous mixing state, thereby allowing treatment without generating short pass of the treating material. As a result, entire zone of the inner chamber 21 can be utilized to perform the treatment.

The media-agitation type wet disperser 1 of the present invention can be widely applied in, for example, printer's ink, paint, polymerization toner, color resist, ceramics fine particles, titanium oxide, metal powder, and pharmaceuticals. These are slurry treating materials, containing inorganic fine particles, organic fine particles, inorganic-organic composite fine particles, or mixture of them.

The amount of media filled in the inner chamber 21 also affects the generation of group motion. When the media filled in the vessel is assumed to be in a state of closest packing in a ring shape peripheral around the agitation part 51, the thickness A of the ring, the length L, and the number N of the small rotors 50 preferably satisfy $0.67N<L/A<1.5N$. The range can prevent the generation of group motion and can make pulverizing treatment and dispersing treatment effective.

What is claimed is:

1. A media-agitation type wet disperser comprising:

a cylindrical vessel;

a cylindrical separator which divides said vessel into an inner chamber and an outer chamber in the diametral direction of the vessel, with pluralities of slits on said separator, connecting both chambers each other;

a rotary shaft rotatably positioned passing through one side of said vessel;

a rotor which rotates while being fixed to said rotary shaft;

a feed opening for a treating material, located at the other side of said vessel and connecting the inside and outside of said inner chamber; and a discharge opening for a treated material, located at the outer periphery of said vessel and connecting the inside and outside of said outer chamber, wherein said rotor is composed of pluralities of small rotors each having a cylindrical agitation part and a dish-shaped holding part, and said agitation part has pluralities of throughholes connecting the inside and outside thereof.

2. The media-agitation type wet disperser according to claim 1, wherein said inner chamber is in a cylindrical shape having a diameter D and a length L between cylinder edges, satisfying the formula (1)

$$0.3N<L/D<0.75N \quad (1)$$

where N is the number of said small rotors.

3. The media-agitation type wet disperser according to claim 1, wherein both ends of said inner chamber have a curved cross sectional shape with a radius of curvature of R, reducing the diameter of said inner chamber from the original inner diameter toward the end of said vessel, satisfying the formula (2) in relation to said diameter D, $$D/30<R<D/3 \quad (2).$$

4. The media-agitation type wet disperser according to claim 1, wherein the outer diameter d of said agitation part and said diameter D satisfy the formula (3), $$0.70<d/D<0.97 \quad (3).$$

5. The media-agitation type wet disperser according to claim 1, wherein the width w of said agitation part, said length L, and said number N satisfy the formula (4), $$0.7N<wN<0.9L \quad (4).$$

6. The media-agitation type wet disperser according to claim 1, wherein said throughholes incline in the direction from the inner peripheral face to the outer peripheral face of said agitation part so as to recess against the rotational direction.

7. The media-agitation type wet disperser according to claim 1, wherein said agitation part has a projection at the outer periphery thereof.

8. The media-agitation type wet disperser according to claim 1, wherein said agitation part is divided into two sections by said holding part, and is provided with said throughhole at both sides of said divided two agitation sections.

9. The media-agitation type wet disperser according to claim 1, wherein said holding part has an opening.

10. A method of dispersing slurry treating material, containing inorganic fine particles, organic fine particles, inorganic-organic composite fine particles, or mixture of them, using the media-agitation type wet disperser according to any one of claims 1 to 9.

11. The method of dispersing fine particles according to claim 10, wherein, when the media filled in said vessel is assumed to be in a state of closest packing in a ring shape around said agitation part, the thickness A of the ring, said length L, and said number N satisfy the formula (5), $$0.67N<L/A<1.5N \quad (5).$$

* * * * *